US006696016B1

(12) United States Patent
Kimura

(10) Patent No.: US 6,696,016 B1
(45) Date of Patent: Feb. 24, 2004

(54) HIGH-CHROMIUM CONTAINING FERRITE BASED HEAT RESISTANT STEEL

(75) Inventor: Kazuhiro Kimura, Ibaraki (JP)

(73) Assignee: Japan as represented by Director General of National Research Institute for Metals, Ibaraki (JP)

( * ) Notice: Subject to any disclaimer, the term of this patent is extended or adjusted under 35 U.S.C. 154(b) by 0 days.

(21) Appl. No.: 09/654,354

(22) Filed: Sep. 1, 2000

(30) Foreign Application Priority Data

Sep. 24, 1999 (JP) ..... 11/309781

(51) Int. Cl.[7] ..... C22C 38/30
(52) U.S. Cl. ..... 420/37; 148/326
(58) Field of Search ..... 420/34, 36, 37; 148/328, 326

(56) References Cited

U.S. PATENT DOCUMENTS 3,746,586 A * 7/1973 Buchanan et al. ..... 148/326
4,218,268 A * 8/1980 Hirishi et al. ..... 148/542
4,640,722 A * 2/1987 Gorman ..... 148/325
4,902,472 A * 2/1990 Isobe et al. ..... 420/49
4,985,091 A * 1/1991 Culling ..... 148/325
5,061,440 A * 10/1991 Watanabe et al. ..... 420/38
5,772,956 A * 6/1998 Hasegawa et al. ..... 420/40
6,299,704 B1 * 10/2001 Igarashi et al. ..... 148/325
2002/0020473 A1 * 2/2002 Sawaragi et al. ..... 148/325

FOREIGN PATENT DOCUMENTS

JP 48-023618 A * 3/1973
JP 53-035617 A * 4/1978 ..... C22C/38/40
JP 07-048654 A * 2/1995 ..... C22C/38/22

OTHER PUBLICATIONS

Smith, William, "Stainless Steels" from Principles of Materials Science and Engineering, McGraw–Hill Book Company, 1986, pp. 499–504.*
Kimura, "Creep Strength Properties of Precipitation Hardened High Cr Ferritic Steels", Current Advances in Materials and Processes, vol. 12 (1999) No. 6, p. 1318 (The Iron and Steel Institute of Japan).

* cited by examiner

*Primary Examiner*—Roy King
*Assistant Examiner*—Harry D. Wilkins, III
(74) *Attorney, Agent, or Firm*—Wenderoth, Lind & Ponack, L.L.P.

(57) ABSTRACT

A high-Cr containing ferrite heat resistant steel having not only an excellent long-term creep strength at a high temperature exceeding 650° C., but also an improved oxidation resistance, which is based on ferritic phase and contains 13% by weight or more of chromium, and containing precipitates of intermetallic compounds.

4 Claims, 14 Drawing Sheets

HIGH-CHROMIUM CONTAINING FERRITE BASED HEAT RESISTANT STEEL

TECHNICAL FIELD OF THE INVENTION

The present invention relates to a high-Cr containing ferrite heat resistant steel. In further detail, the invention according to the present application relates to a high-Cr ferrite heat resistant steel having not only an excellent long-term creep strength at a high temperature exceeding 650° C., but also an improved oxidation resistance.

BACKGROUND OF THE INVENTION

Conventionally, the creep strength of a ferrite based, heat resistant steel has been improved heretofore by converting the ferritic texture into a tempered martensitic texture having a higher creep strength.

However, a tempered martensitic texture is unstable at high temperatures because it undergoes textural change and becomes heterogeneous. This decreases the creep strength. Furthermore, dislocations present in the martensite accelerates the long term creep deformation. Thus, the texture is changed influenced by the heat applied at welding as to impair the creep strength at the welded portion Although Cr (chromium) is known as an element effective for improving the oxidation resistance of a steel, the incorporation of Cr at a higher concentration of 12% by weight or more results in the generation of a δ-ferrite phase which decreases the creep strength and the toughness. Accordingly, austenite stabilizing agents such as Ni, Cu and Co, have been added to the ferritic heat resistant steel known heretofore in order to suppress the generation of δ-ferrite phase.

However, the addition of Ni or Cu lowers the transformation temperatures of austenite and ferrite. To achieve long term stability of the high-temperature strength, it is advantageous to set the tempering temperature higher after the normalization; however, the addition of Ni or Cu results in a lower tempering temperature because it thus lowers the transformation temperature of austenite and ferrite. Accordingly, it is practically unfeasible to add Cr at a quantity exceeding a concentration of 12% by weight.

DISCLOSURE OF THE INVENTION

The invention according to the present application has been made in the light of the aforementioned circumstances, and an object thereof is to provide a high-Cr ferrite heat resistant steel having excellent long-term creep strength at a high temperature exceeding 650° C., and yet having an improved oxidation resistance.

As described above, a conventional ferritic heat resistant steel based on the tempered martensitic texture suffers an abrupt drop in creep strength because it undergoes a heterogeneous textural change in the vicinity of the grain boundaries when subjected to higher temperatures over 650° C. for a long duration of time because of the unstable texture.

Accordingly, the inventors of the present invension extensively studied a means for achieving textural stability at higher temperatures. As a result, it has been found that the ferritic heat resistant steel having a greatly improved long term creep strength at high temperatures can be obtained by realizing a texture based on a ferritic phase and precipitating therein an intermetallic compound of a Laves phase, a $\mu$ phase, a σ phase, or a compound represented by $Ni_3X$, where X is Al or Ti. The present invention has been accomplished based on these findings.

More specifically, in accordance with the first aspect of the invention of the present application, there is provided a heat resistant high-chromium containing ferrite steel containing 13% by weight or more of chromium and based on ferritic phase and containing precipitates of intermetallic compounds.

Furthermore, according to a second aspect of the invention of the present application, there is provided, a heat resistant high-chromium containing ferrite steel above, wherein the intermetallic compound is at least one type of precipitates selected from the group consisting of a Laves phase, a $\mu$ phase, a σ phase, or a compound represented by $Ni_3X$, where X is Al or Ti.

BEST MODE FOR CARRYING OUT THE INVENTION

Figure 1:
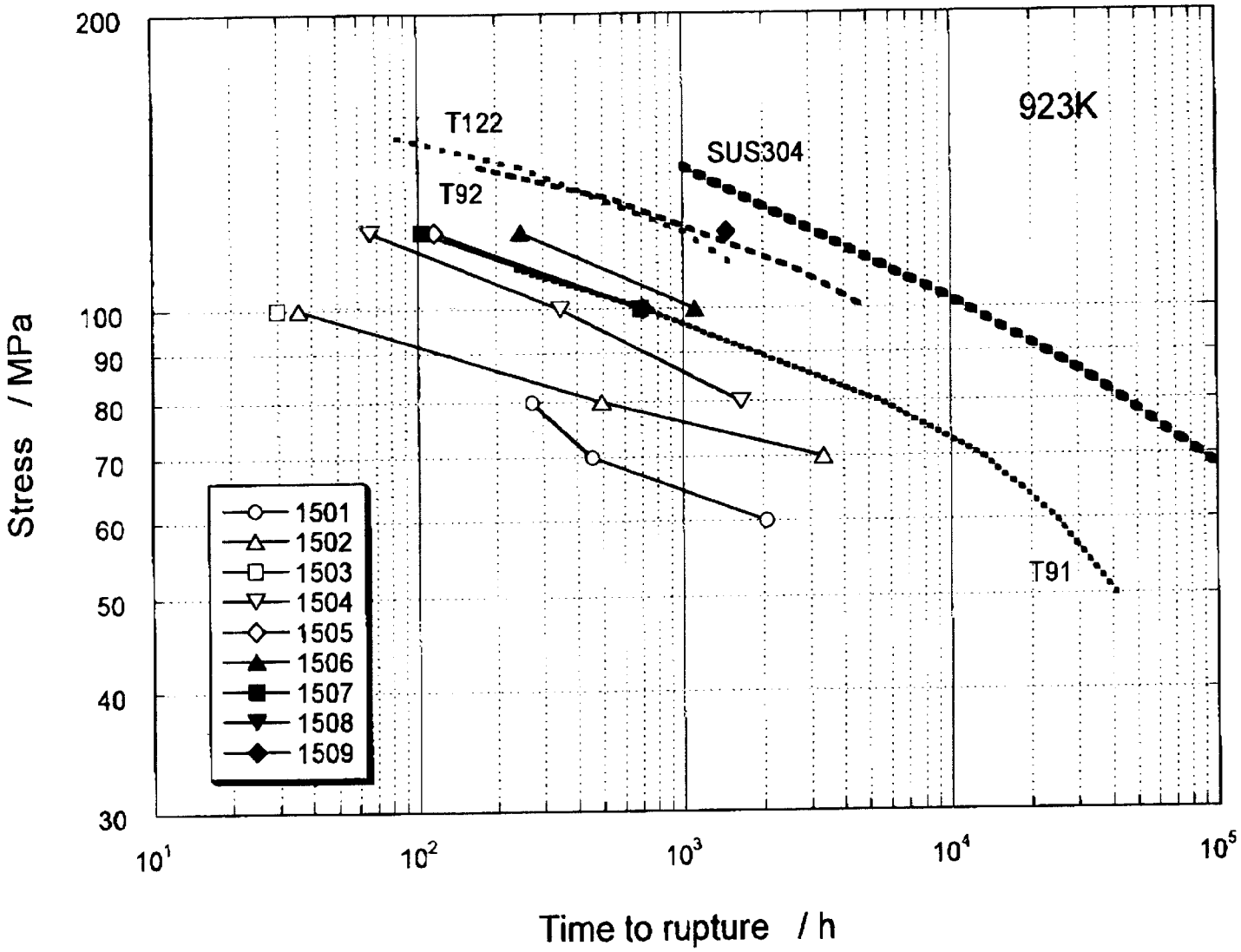
FIG. 1 shows the stress vs. time to breakage curve at 650° C. of test specimens according to Examples 1 to 9, and Comparative Examples 1 to 3.

As described above, the high-Cr ferrite heat resistant steel according to the invention of the present application contains 13% by weight or more of chromium and is based on ferritic phase, and at the same time, contains precipitates of intermetallic compounds. As the intermetallic compounds, there can be specifically mentioned at least one type of phases selected from the group consisting of a Laves phase ($Fe_2W$, $Fe_2Mo$), a $\mu$ phase, a $\sigma$ phase, or a compound represented by $Ni_3X$, where X is Al or Ti. The intermetallic compounds above precipitation hardens the ferritic phase. Furthermore, because the basic phase constituting the high-Cr ferrite heat resistant steel is ferrite and not the tempered martensite that is unstable at high temperatures, the high-Cr ferrite heat resistant steel according to the invention of the present application realizes an excellent creep strength for a long duration of time. Because a ferritic matrix phase equivalent to that of the mother material is obtained by performing heat treatment after welding, the strength can be maintained without being impaired by the thermal influence at the welded portion.

In the high-Cr ferrite heat resistant steel according to the invention of the present application, the basic ferritic phase preferably accounts for 70% by volume or more.

Furthermore, because the high-Cr ferrite heat resistant steel according to the invention of the present application contains Cr at a high quantity of 13% by weight or more, it exhibits excellent resistances against oxidation and water vapor oxidation as compared with a conventional ferritic heat resistant steel. Although the incorporation of Cr at a high quantity may lower the toughness, the toughness of the high-Cr ferrite heat resistant steel according to the invention of the present application is maintained favorably because the intermetallic compounds form a uniform subgrain as to suppress the growth of basic ferritic phase into coarse crystals.

Regarding to the present invention, as a practical embodiment, it is desirable that the heat resistant high-chromium ferrite steel contains 0.5% Mo by weight or more and 1.0% W by weight or more.

It's also derisable that said the ferrite steel conains 1.0% Co by weight or more.

Furthermore, it's can be shown, as desirable embodiment, that the heat resistant high-chromium containing ferrite steel has a following chemical composition (weight %);

| | |
|---|---|
| Cr | 13~30 |
| Mo | 0.5~8.0 |
| W | 1.0~8.0 |
| Co | 1.0~10.0 |
| C | 0.50 or less |
| N | 0.20 or less |
| B | 0.01 or less |
| Nb | 0.01~2.0 |
| Fe | residue |

and may contain inevitable impurities.

The present application also provides a method for producing the heat resistant high-chromium containing ferrite steel as mentioned above. The method can be comprised with steps of hot working bulky steel derived from a melt raw materials and annealing the hot worked steel.

As preferable embodiment, it can be shown that the annealing step is comprised with processes of a heating process at the temperature of 1000° C. or more and a cooling process in a furnace.

The present invention is described in further detail by making reference to specific examples.

EXAMPLES 1 TO 16 AND COMPARATIVE EXAMPLES 1 TO 3

Test specimens each having the chemical composition shown in Table 1 were prepared. Each of the test specimens was prepared by first producing an ingot 10 kg in weight in a vacuum high frequency melting furnace, hot forging the resulting ingot into a cylindrical rod about 13 mm in diameter, and annealing by holding at 1,200° C. for a duration of 30 minutes and cooling in the furnace. The test specimens were subjected to creep tests at 600° C., 650° C., and 700° C., as well as to the measurement of hardness and observation under transmission electron microscope.

TABLE 1

| | | Chemical Composition (% by weight) | | | | | | | | | |
|---|---|---|---|---|---|---|---|---|---|---|---|
| | Alloy No. | C | Cr | Mo | W | V | Nb | Cu | Co | N | B |
| Ex. 1 | 1501 | 0.10 | 15.0 | 0.5 | 1.8 | 0.20 | 0.05 | — | — | 0.07 | 0.003 |
| Ex. 2 | 1502 | 0.10 | 15.0 | 1.0 | 3.0 | 0.20 | 0.05 | — | — | 0.07 | 0.003 |
| Ex. 3 | 1503 | 0.10 | 15.0 | 1.0 | 3.0 | 0.40 | 0.10 | — | — | 0.09 | 0.003 |
| Ex. 4 | 1504 | 0.10 | 15.0 | 1.0 | 6.0 | 0.20 | 0.05 | — | — | 0.07 | 0.003 |
| Ex. 5 | 1505 | 0.10 | 15.0 | 1.0 | 6.0 | 0.40 | 0.10 | — | — | 0.08 | 0.003 |
| Ex. 6 | 1506 | 0.10 | 15.0 | 1.0 | 3.0 | 0.20 | 0.06 | — | 3.0 | 0.08 | 0.003 |
| Ex. 7 | 1507 | 0.10 | 15.0 | 1.0 | 3.0 | 0.40 | 0.10 | — | 3.0 | 0.08 | 0.003 |
| Ex. 8 | 1509 | 0.10 | 15.0 | 1.0 | 6.0 | 0.40 | 0.10 | — | 3.0 | 0.08 | 0.003 |
| Ex. 9 | 1508 | 0.10 | 15.0 | 1.0 | 6.0 | 0.20 | 0.05 | — | 3.0 | 0.07 | 0.003 |
| Ex. 10 | 2001 | 0.10 | 20.0 | 0.5 | 1.8 | 0.20 | 0.05 | — | — | 0.07 | 0.003 |
| Ex. 11 | 2002 | 0.10 | 20.0 | 1.0 | 3.0 | 0.20 | 0.05 | — | — | 0.07 | 0.003 |
| Ex. 12 | 2003 | 0.10 | 20.0 | 1.0 | 3.0 | 0.20 | 0.05 | — | 5.0 | 0.07 | 0.003 |
| Ex. 13 | 2004 | 0.10 | 20.0 | 1.0 | 3.0 | 0.40 | 0.10 | — | 5.0 | 0.06 | 0.002 |
| Ex. 14 | 2005 | 0.10 | 20.0 | 1.0 | 6.0 | 0.20 | 0.05 | — | 5.0 | 0.07 | 0.003 |
| Ex. 15 | 2006 | 0.10 | 20.0 | 1.0 | 6.0 | 0.40 | 0.10 | — | 5.0 | 0.09 | 0.003 |
| Ex. 16 | 2007 | 0.10 | 20.0 | 1.0 | 9.0 | 0.40 | 0.10 | — | 5.0 | 0.07 | 0.002 |
| Comp.1 | ASME T91 | 0.10 | 9.0 | 1.0 | — | 0.20 | 0.05 | — | — | 0.05 | — |
| Comp.2 | ASME T92 | 0.10 | 9.0 | 0.5 | 1.8 | 0.20 | 0.05 | — | — | 0.06 | 0.003 |
| Comp.3 | ASME T122 | 0.10 | 11.0 | 0.5 | 2.0 | 0.20 | 0.05 | 1.0 | — | 0.05 | 0.003 |

The texture of each of the test specimens obtained in Examples 1 to 16 after annealing was found to be a ferrite containing carbides, but the precipitation density of the carbides was low. For the test specimens of Examples 6 to 9, and 12 to 16 each containing Co, martensite was found to account for about 5 to 6% by volume. After the annealing, the test specimens of Examples 1 to 5, and 10 to 11 were found to yield a hardness Hv in the range of from 160 to 180, and those of Examples 6 to 9 and 12 to 16 yielded a high hardness Hv in the range of from 230 to 250.

Figure 2:
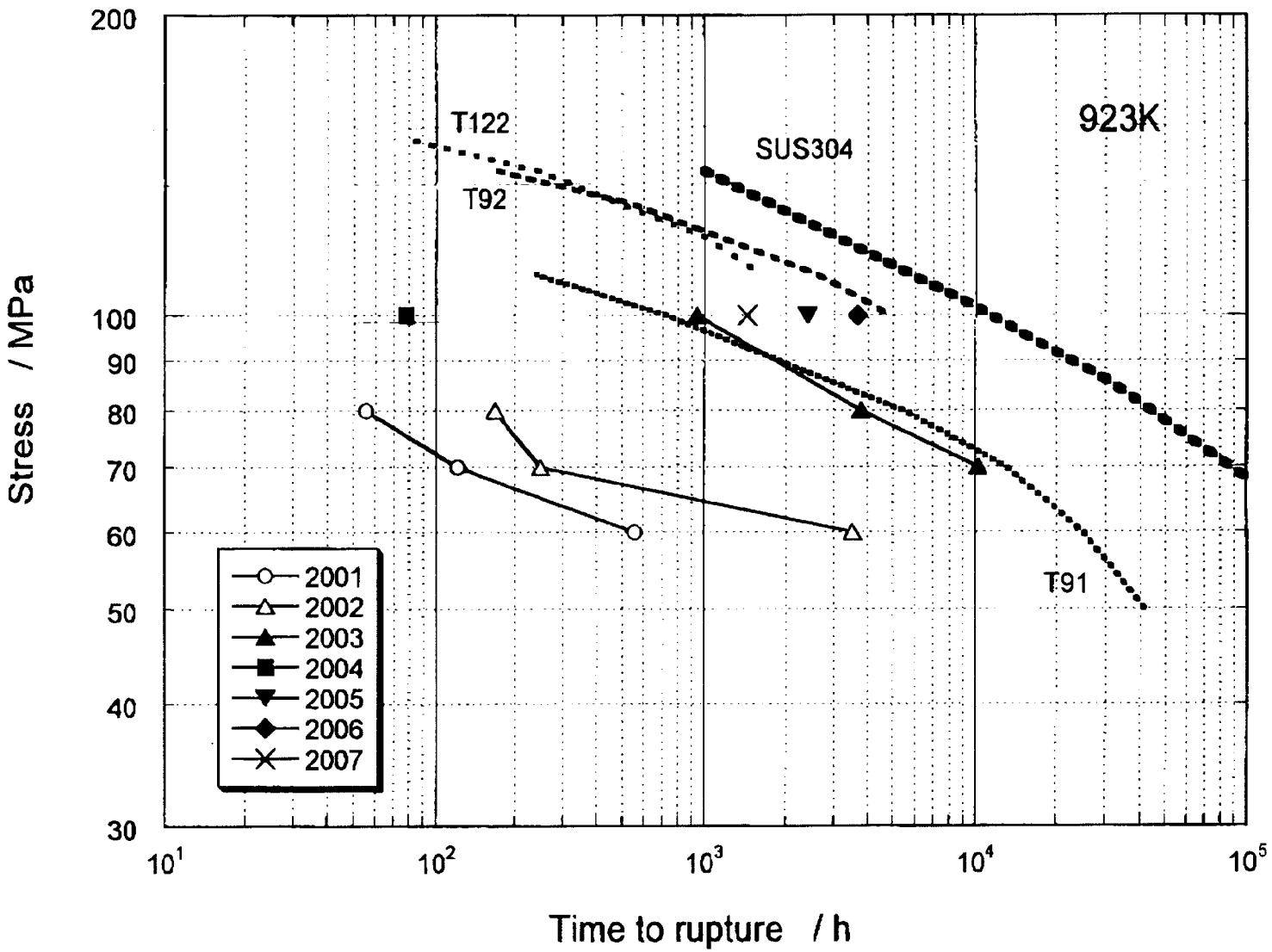
FIG. 2 shows the stress vs. time to breakage curve at 650° C. of test specimens according to Examples 10 to 16.

FIGS. 1 and 2 show the stress vs. time to breakage curve at 650° C. The curve reads that the test specimens (ferritic steel) for Examples 1 to 9 and 10 to 16 yield higher stability in creep strength for a long duration of time as compared with the test specimens of Comparative Examples 1 to 3 (martensitic steel), and SUS 304 of the conventional type. On the other hand, the test specimens of Comparative Examples 1 to 3, and SUS 304 show considerable drop in long term creep strength.

Figure 3:
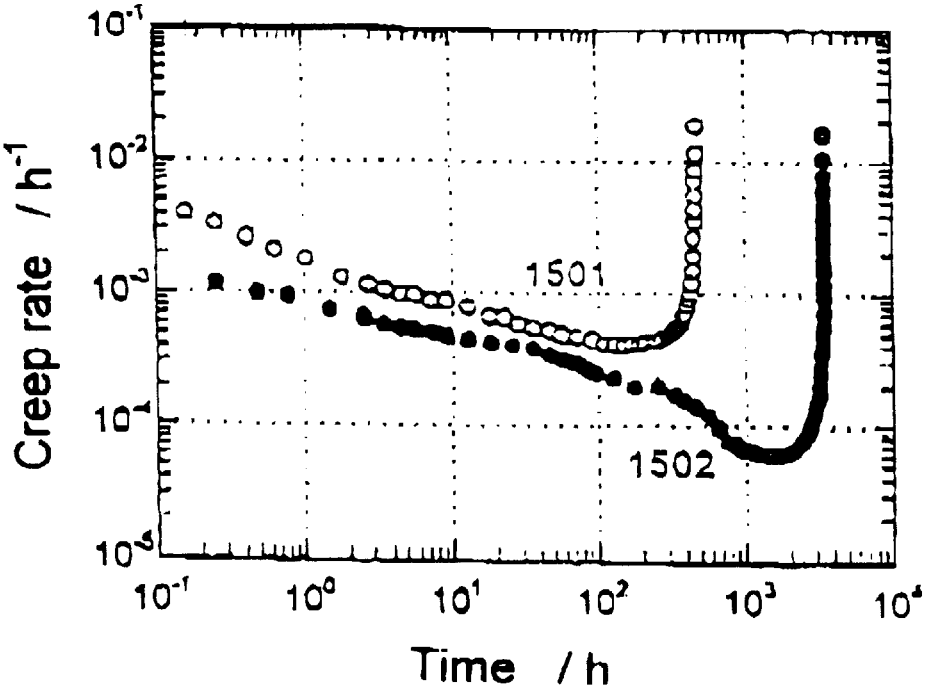
FIG. 3 shows the creep rate vs. time curve obtained as a result of creep tests performed at 650° C. and 70 MPa on test specimens according to Examples 1 and 2.

FIG. 3 shows the creep rate vs. time curve obtained as a result of creep tests performed at 650° C. and 70 MPa on test specimens according to Examples 1 and 2.

The test specimens of Examples 1 and 2 both contain 15% by weight of Cr, and the test specimen of Example 2 contains the intermetallic compound elements Mo and W at a higher amount as compared with that of Example 1. It can be seen that the creep rate is lower and that the time to creep rupture is about 10 times as long as that of the Example 1. Thus, it can be understood that the creep strength of the test specimen of Example 2 is higher than that of the test specimen of Example 1.

Figure 4:
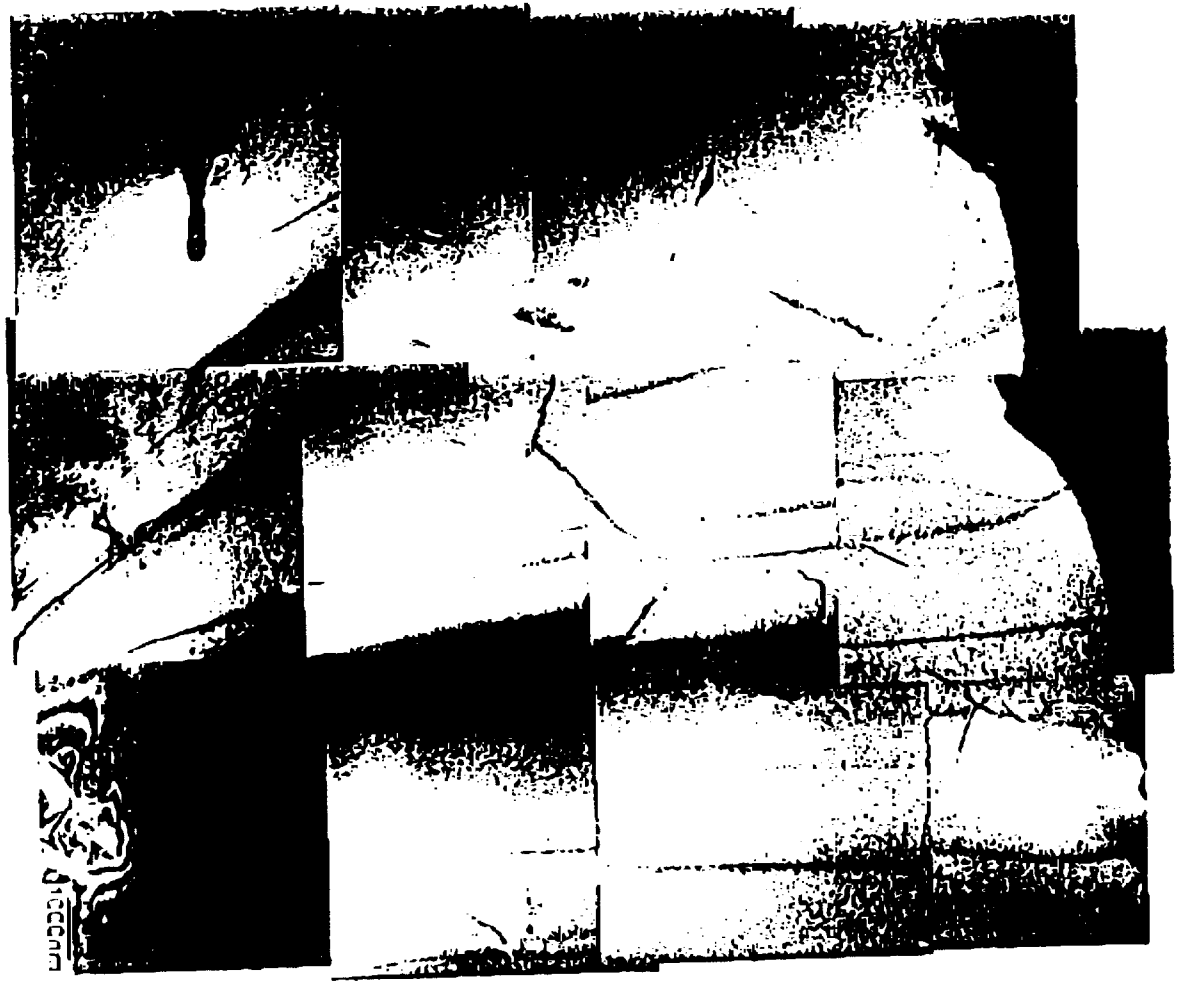
FIG. 4 is a micrograph obtained under transmission electron microscopy showing the texture of the test specimen just after annealing according to Example 2.
Figure 5:
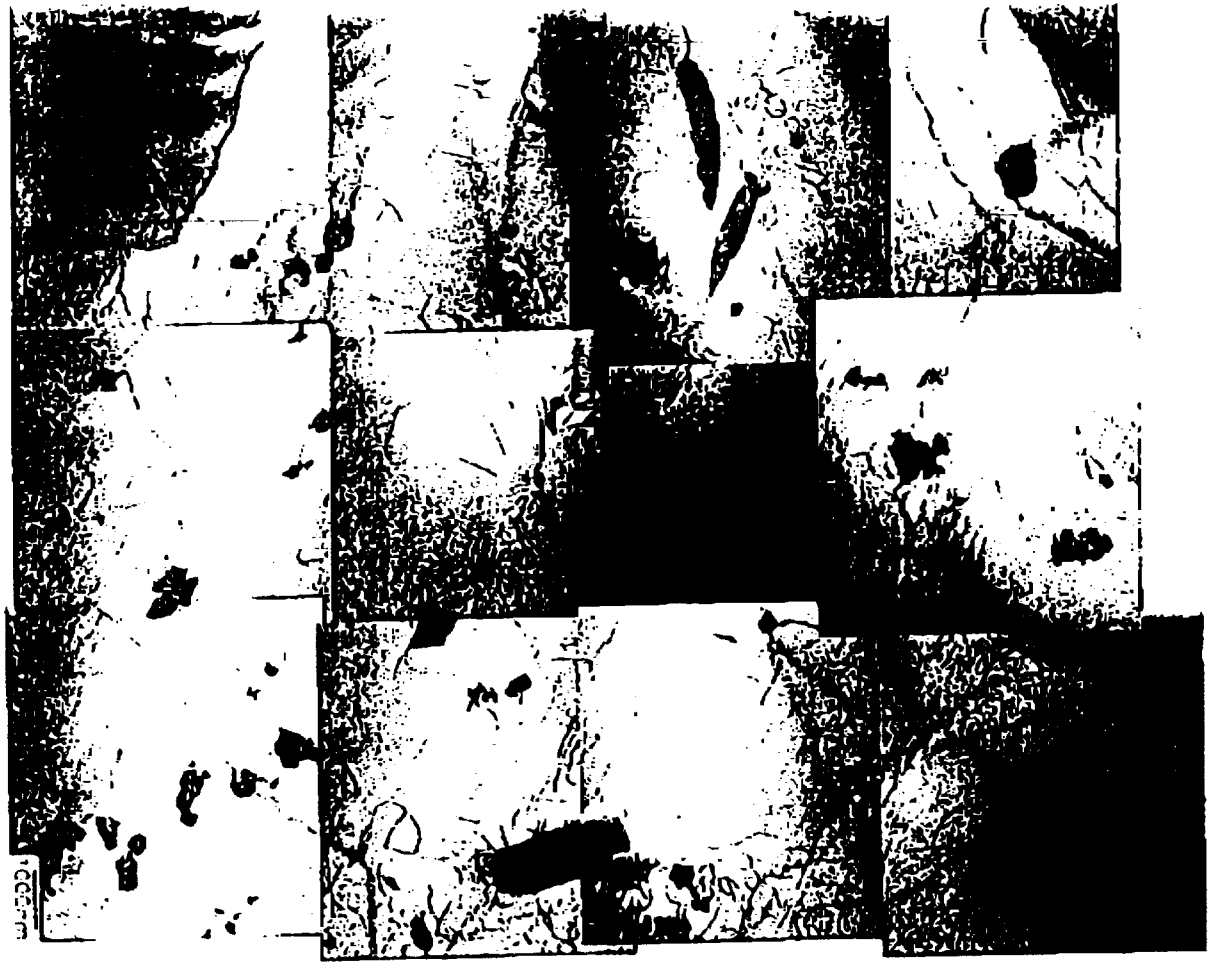
FIG. 5 is a micrograph obtained under transmission electron microscopy showing the texture of the test specimen according to Example 2, obtained 100 hours after performing the creep test.
Figure 6:
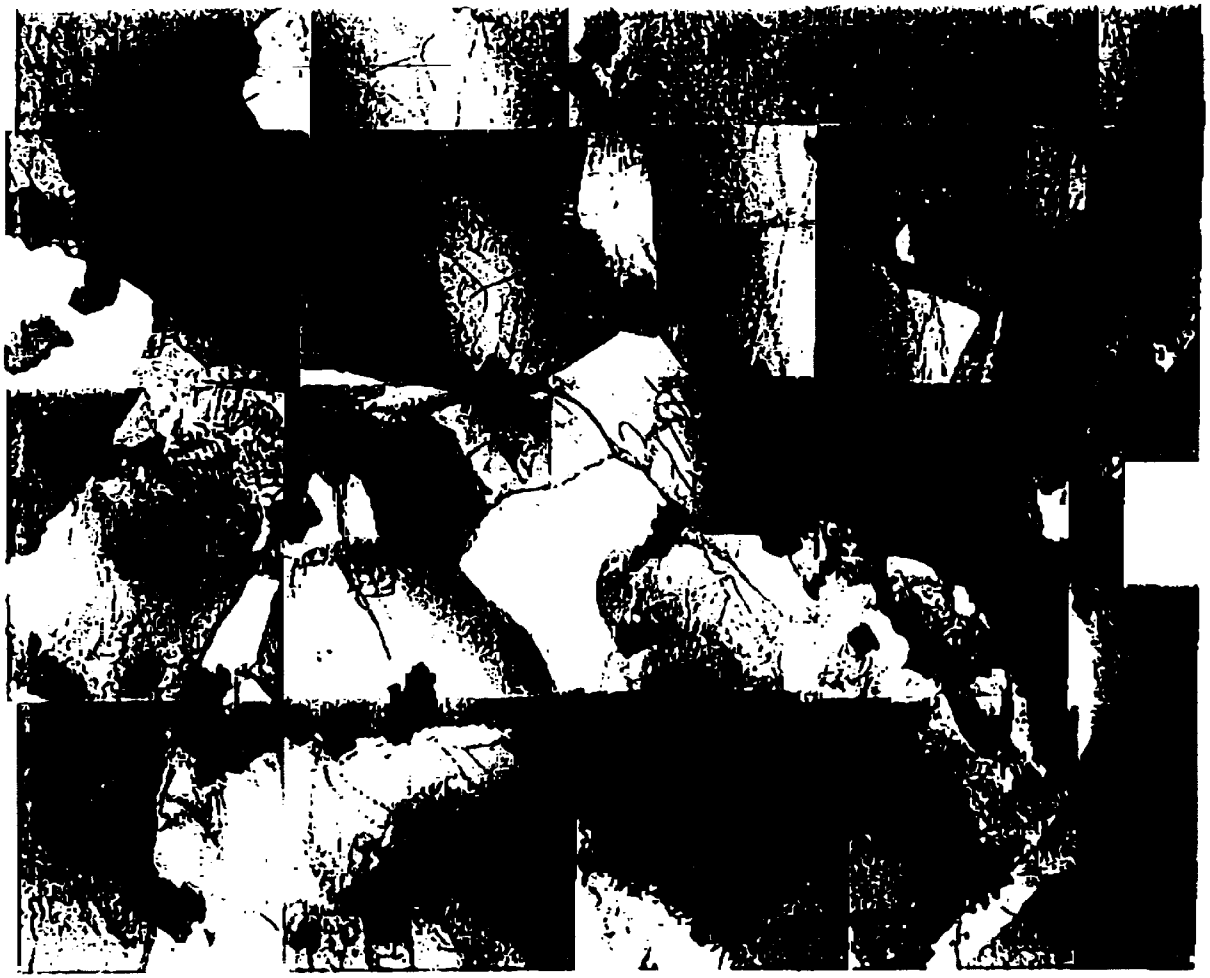
FIG. 6 is a micrograph obtained under transmission electron microscopy showing the texture of the test specimen according to Example 2, obtained 1,000 hours after performing the creep test.

FIGS. 4 to 6 each show the textures of the test specimen according to Example 2, obtained just after the annealing, after 100 hours of the creep test, and after 1,000 hours of the creep test.

The figures show a uniform texture, and the black spots observed in the figure represent the intermetallic compound. It can be seen that the intermetallic compound precipitates in a larger amount during the creep test.

From the results above, it can be understood that the creep strength is improved by the precipitation of the intermetallic compound which reinforces the ferritic phase, and that the precipitation hardening of the intermetallic compound is further accelerated by increasing the addition of Mo and W.

Figure 7:
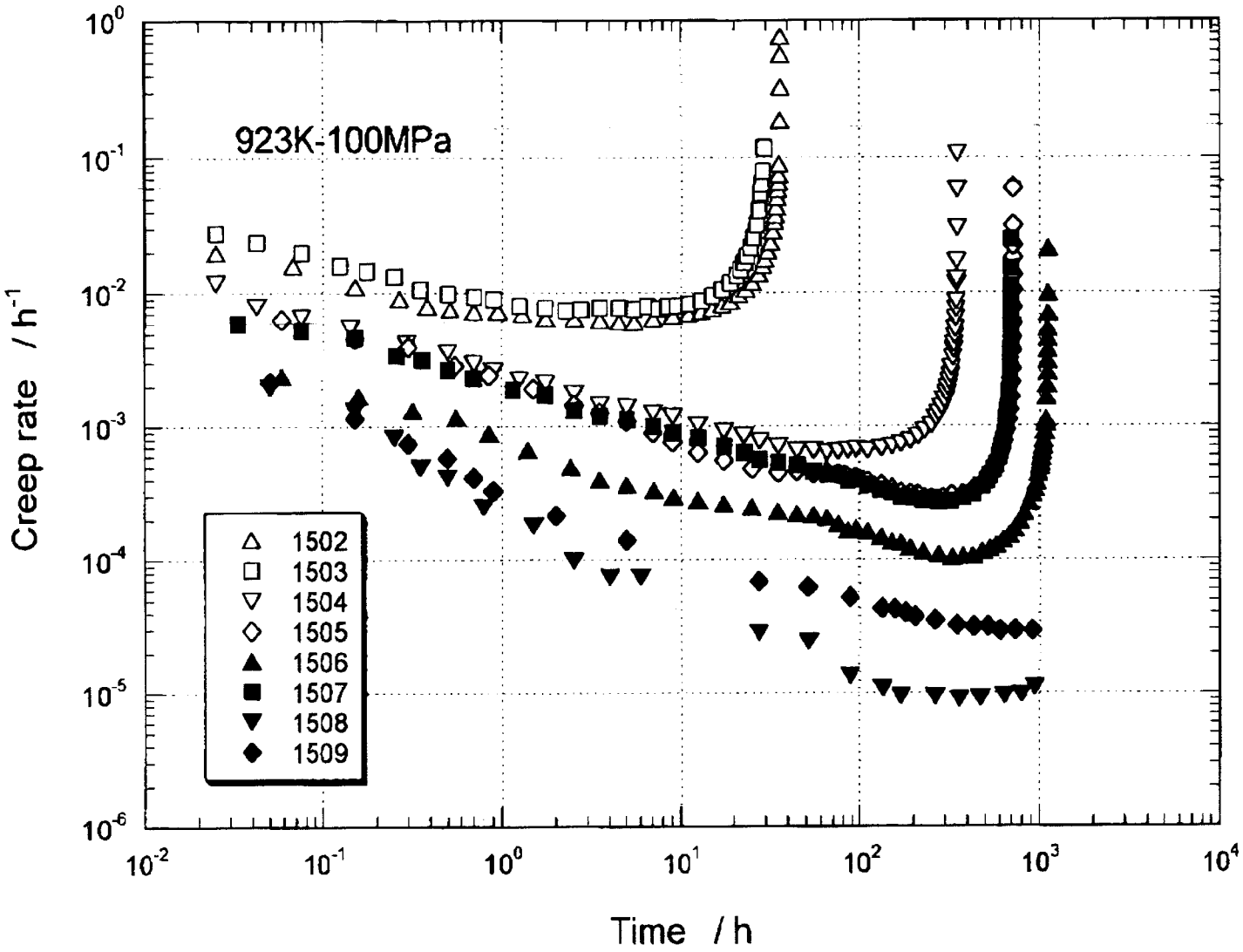
FIG. 7 shows the creep rate vs. time curve obtained as a result of creep tests performed at 650° C. and 100 MPa on test specimens according to Examples 2 to 9.

FIG. 7 shows the creep rate VS. time curve obtained as a result of creep tests performed at 650° C. and 100 MPa on test specimens according to Examples 2 to 9.

The test specimens of Examples 2 to 9 each contain 15% by weight of Cr, and the test specimens of Examples 4 to 5, and 8 to 9 contain the intermetallic compound elements W at a higher amount as compared with that of Examples 2 to 3, and 6 to 7. The test specimens of Examples 6 to 9 each contain 3% by weight of Co.

Based on the higher amount of intermetallic compound element W, it can be understood that the creep strength of the test specimens of the test specimens of Examples 4 and 5 are higher than that of the test specimens of Examples 2 and 3.

Additionally, based on the elements Co, it can be understood that the creep strength of the test specimens of Examples 6 and 7 are higher than that of the test specimens of Examples 2 and 3, and that the creep strength of the test specimens of Examples 8 and 9 are higher than that of the test specimens of Examples 4 and 5.

Figure 8:
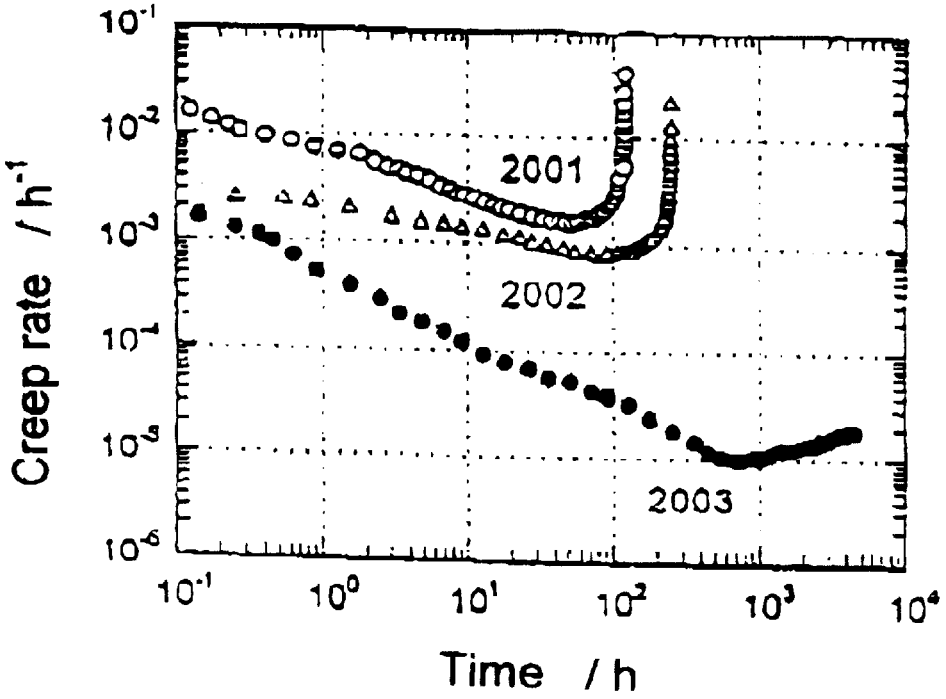
FIG. 8 is a graph showing the creep rate vs. time curve obtained as a result of creep tests performed at 650° C. and 70 MPa on test specimens according to Examples 10 to 12.

FIG. 8 shows the creep rate vs. time curve obtained as a result of creep tests performed at 650° C. and 70 MPa on test specimens according to Examples 10 to 12.

The test specimens according to Examples 10 to 12 contain Cr at a higher amount as compared with those according to Examples 1 to 9. Similar to the case of Examples 1 and 2, the results obtained in creep test for the test specimens of Examples 10 and 11 show that the precipitation hardening attributed to the intermetallic compound increases with increasing amount of addition of Mo and W.

The test specimen according to Example 12 is obtained by adding Co to the test specimen of Example 11. By comparing the result of Example 12 with that of Example 11, it can be understood that the amount of intermetallic compound precipitate increases with the addition of Co, and that the creep strength is thereby improved.

Figure 9:
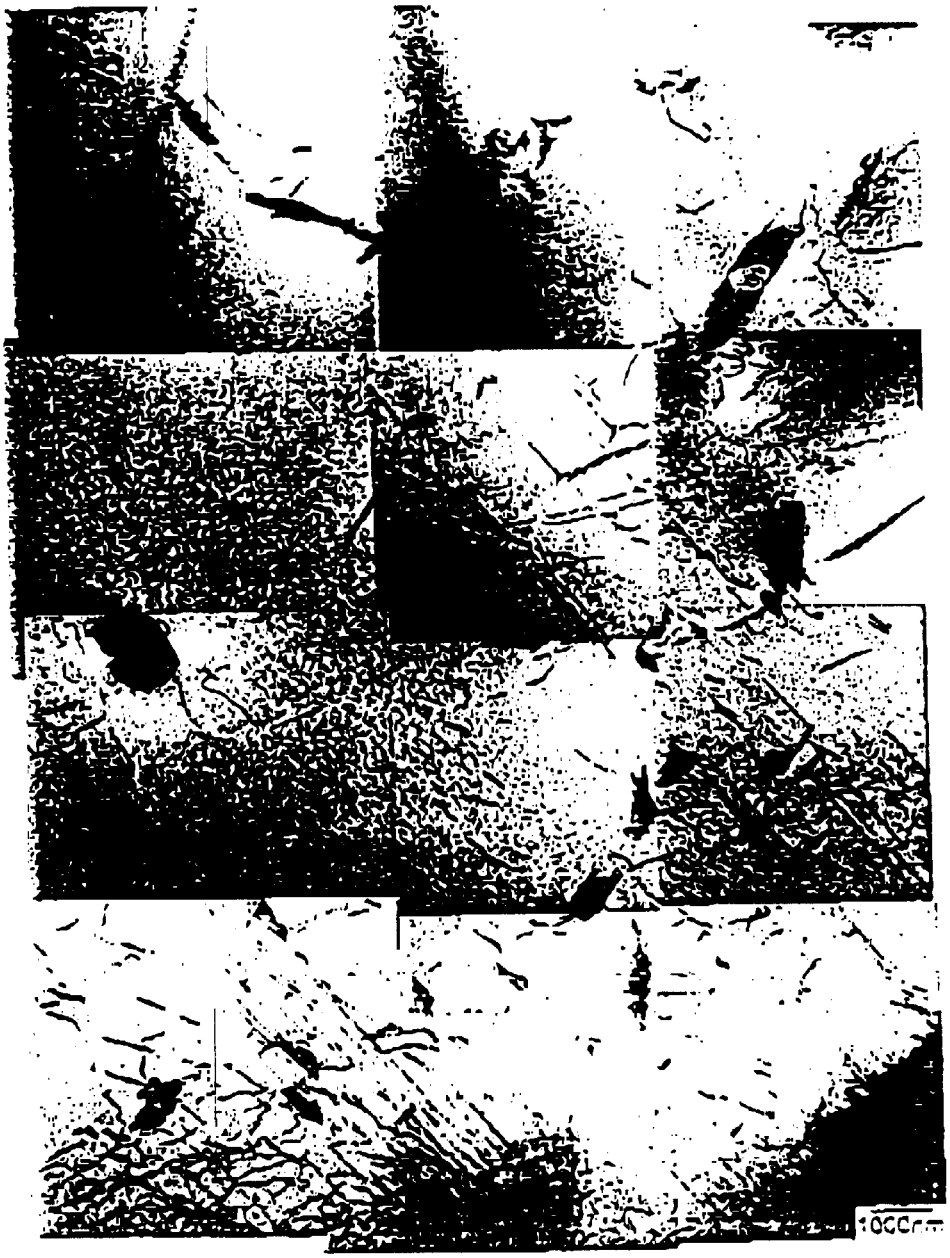
FIG. 9 is a micrograph obtained under transmission electron microscopy showing the texture of the test specimen just after annealing according to Example 12.
Figure 10:
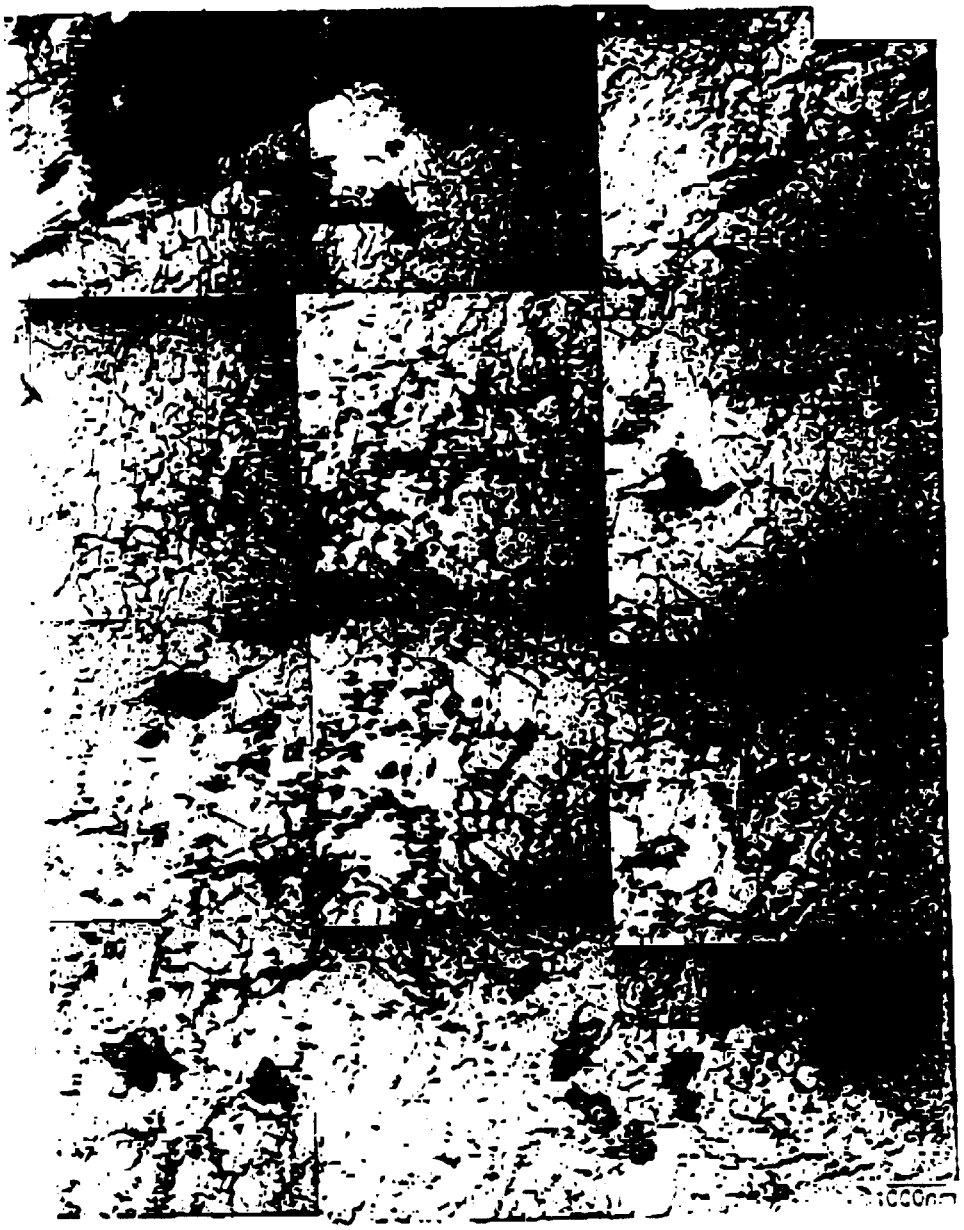
FIG. 10 is a micrograph obtained under transmission electron microscopy showing the texture of the test specimen according to Example 12, obtained 100 hours after performing the creep test.

FIGS. 9 and 10 each show the texture of the test specimen of Example 12, each obtained just after annealing and 100 hours after the creep test.

Referring to FIGS. 9 and 10, the intermetallic compounds can be seen as black spots, and it can be understood that the intermetallic compound precipitates at a large amount.

Figure 11:
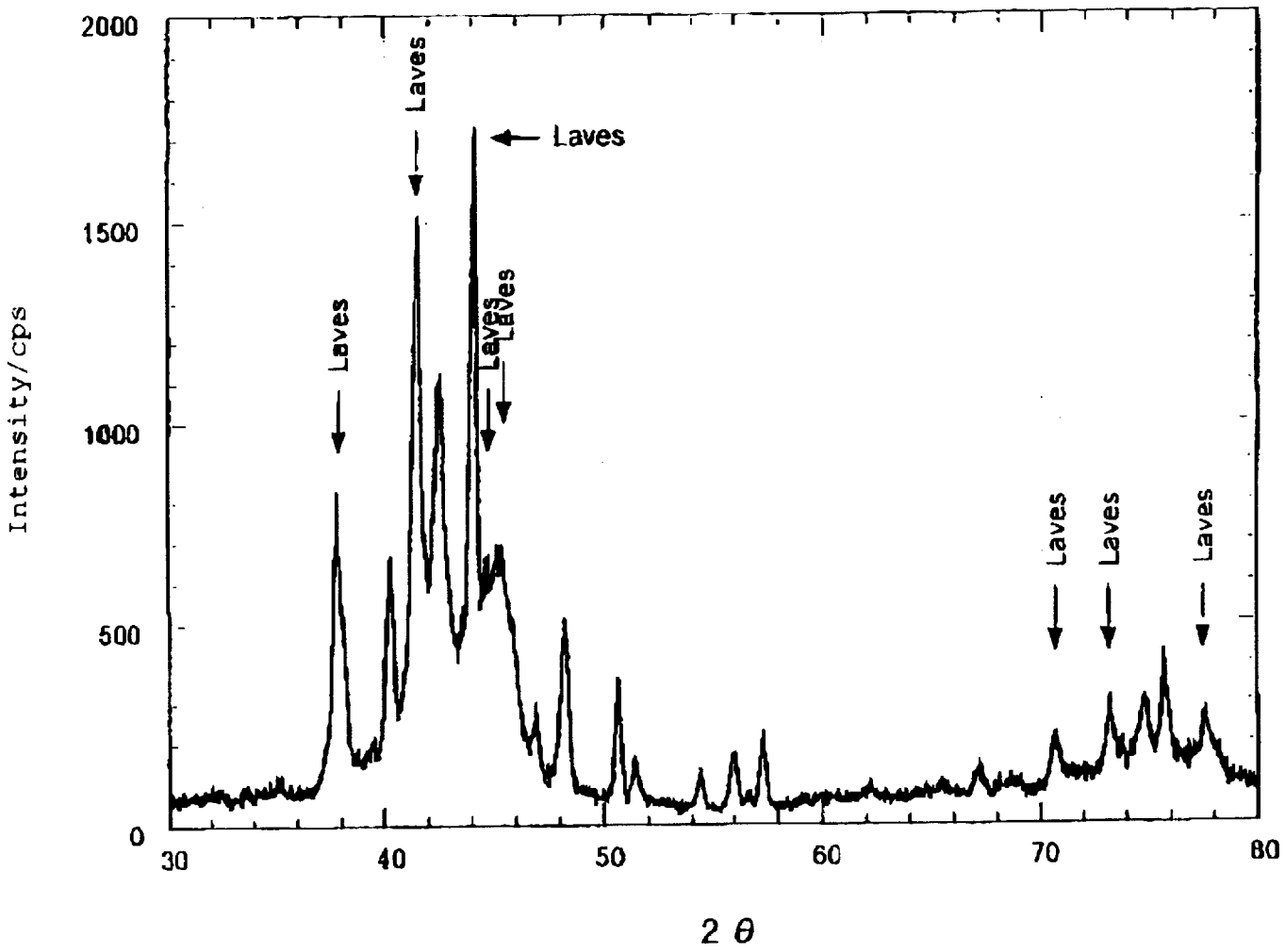
FIG. 11 is the X-ray diffractogram of an electrolytically extracted residue obtained from the test specimen subjected to creep test at 650° C. and 70 MPa and stopped after 1,000 hours.

FIG. 11 shows an X-ray diffractogram of an electrolytically extracted residue obtained from the test specimen subjected to creep test at 650° C. and 70 MPa and by stopping the test after 1,000 hours. The formation of an intermetallic compound, i.e., the Laves phase, is confirmed.

Figure 12:
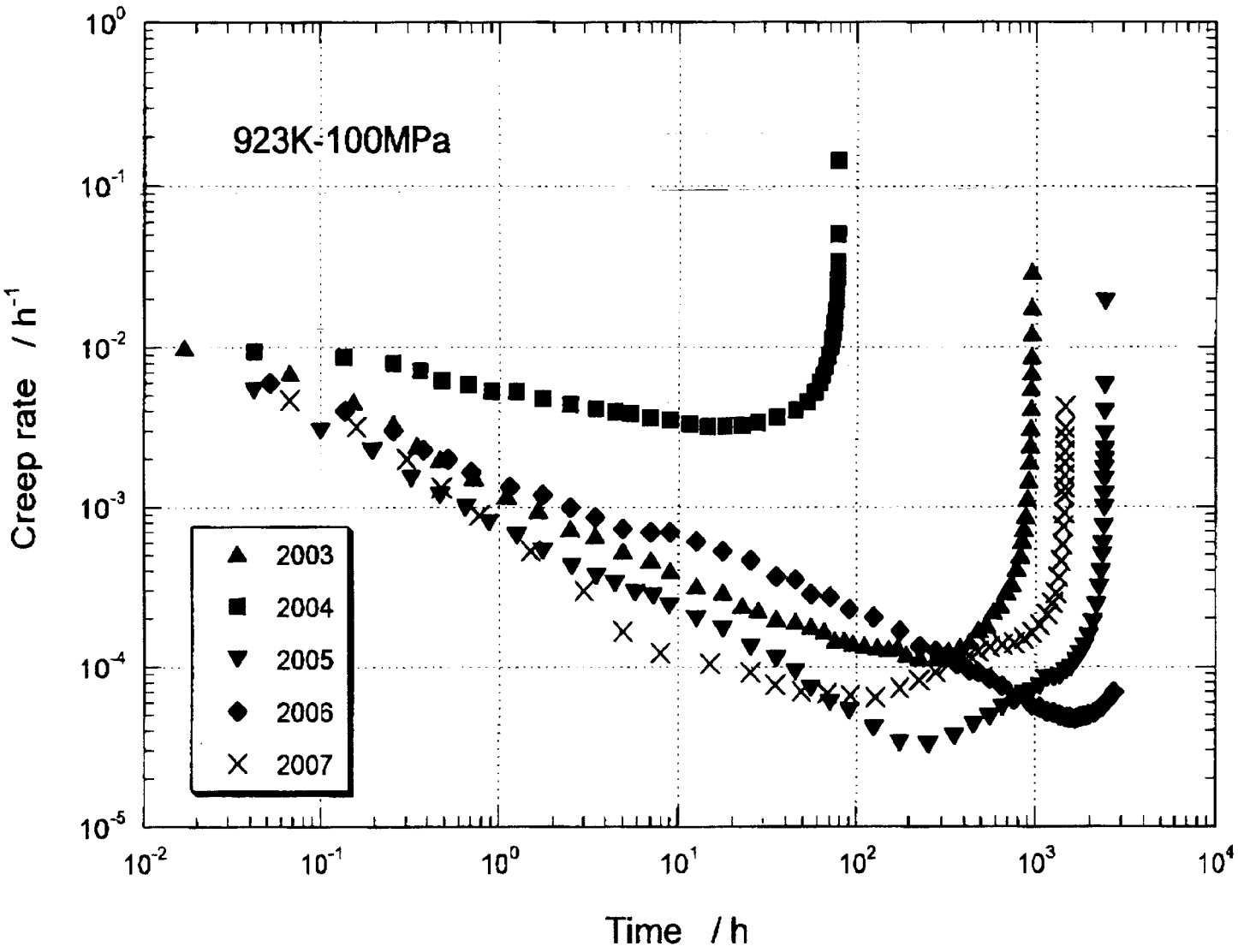
FIG. 12 shows the creep rate vs. time curve obtained as a result of creep tests performed at 650° C. and 100 MPa on test specimens according to Examples 12 to 16.

FIG. 12 shows the creep rate vs. time curve obtained as a result of creep tests performed at 650° C. and 100 MPa an test specimens according to Examples 12 to 16.

By comparing Examples 12 and 13, it can be understood that the creep strength is decreased that by the excess amount of elements V and Nb. However, by comparing Example 13 and Examples 15 to 16, it can be understood that element W can increase the creep strength.

Figure 13:
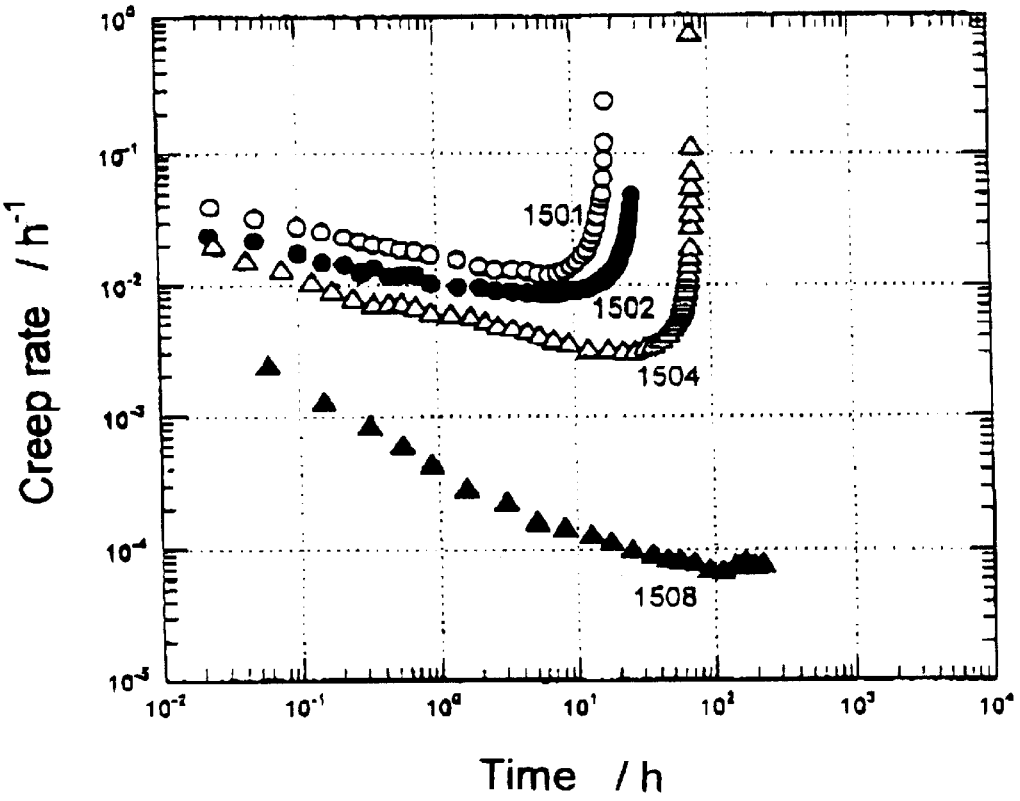
FIG. 13 shows the creep rate vs. time curve obtained as a result of creep tests performed at 700° C. and 70 MPa on test specimens according to Examples 1 to 3, and 8.

FIG. 13 shows the creep rate vs. time curve obtained as a result of creep tests performed at 700° C. and 70 MPa on test specimens according to Examples 1 to 3, and 8. It can be seen therefrom that the creep strength of the test specimen increases in the order of Example 1, Example 2, Example 3, and Example 8.

The test specimens of Examples 1 to 3, and 8 all contain 15% by weight of Cr, and the test specimen of Example 2 contains the intermetallic compound elements Mo and W at a higher amount as compared with that of Example 1. The test specimen of Example 3 contains the intermetallic compound element W at a higher amount as compared with the case of Example 2. Furthermore, the test specimen of Example 8 is obtained by adding Co, an element which increases the amount of precipitated intermetallic compound, to the test specimen of Example 3.

From the above facts, it can be understood that the amount of precipitated intermetallic compound increases in the order of Example 1, Example 2, Example 3, and Example 8, and resulted in an increase in creep strength.

Figure 14:
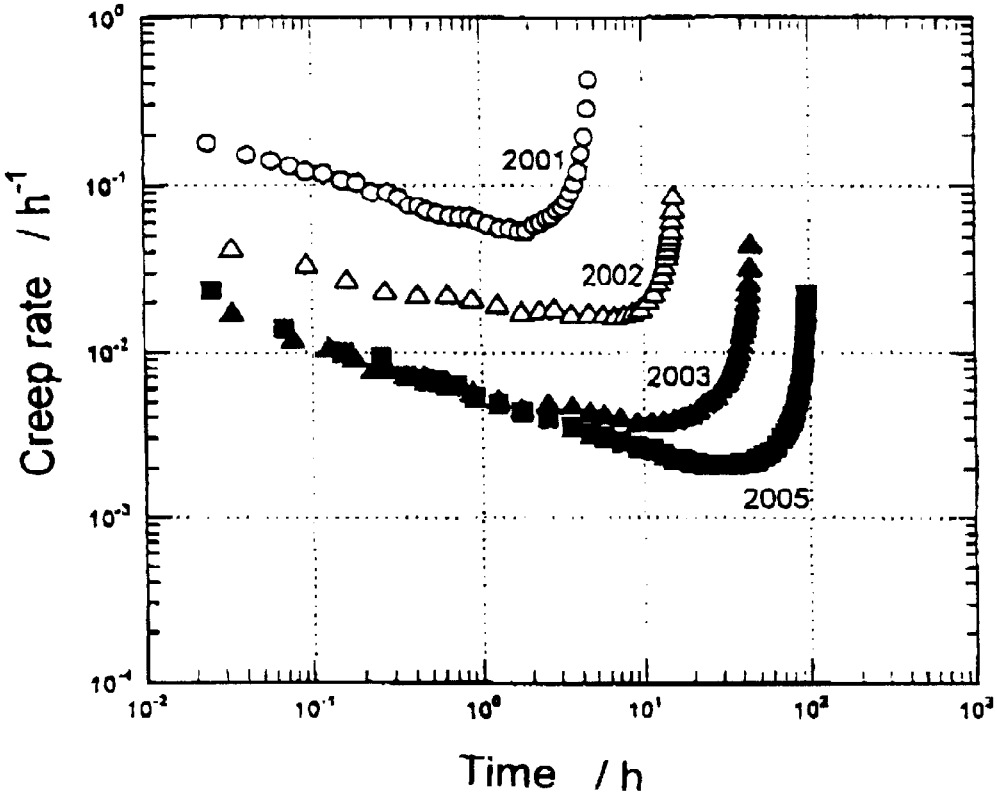
FIG. 14 shows the creep rate vs. time curve obtained as a result of creep tests performed at 700° C. and 70 MPa on test specimens according to Examples 10 to 12, and 14.

FIG. 14 shows the creep rate vs. time curve obtained as a result of creep tests performed at 700° C. and 70 MPa on test specimens according to Examples 10 to 12, and 14. It can be seen therefrom that the creep strength of the test specimen increases in the order of Example 10, Example 11, Example 12, and Example 14.

The test specimens of Examples 10 to 12, and 14 all contain 20% by weight of Cr, and the test specimen of Example 11 contains the intermetallic compound elements Mo and W at a higher amount as compared with that of Example 10. The test specimen of Example 12 is obtained by adding Co, an element which increases the amount of precipitated intermetallic compound, to the test specimen of Example 11. The test specimen of Example 14 contains the intermetallic compound element W at a higher amount as compared with the case of Example 12.

It can be understood from the above facts that the amount of precipitated intermetallic compound increases in the order of Example 10, Example 11, Example 12, and Example 14, and that this resulted in an increase in creep strength in this order.

It should be understood that the invention according to the present application is not limited by the embodiments and the examples above, and various modifications can be made on chemical compositions, types of the intermetallic compound, process conditions, etc.

As described above, the invention according to the present application provides a high-Cr ferrite heat resistant steel having not only an excellent long-term creep strength at a high temperature exceeding 650° C., but also an improved oxidation resistance. By taking into consideration the distinguished properties, the high-Cr ferrite heat resistant steel of the present invention is suitable as a material of apparatuses for use under high temperature and high pressure, such as boilers, nuclear power plant installations, chemical industry apparatuses, etc., and the use thereof is believed to bring about an improvement in energy efficiency of power plants, an improvement in reaction efficiency of chemical industry apparatuses, etc.

While the invention has been described in detail by making reference to specific examples, it should be understood that various changes and modifications can be made without departing from the scope and the spirit of the present invention.

What is claimed is:

1. A heat resistant high-chromium containing ferrite steel based on ferritic phase and containing 13–30% by weight of chromium and 1.0–10.0% by weight of cobalt, and having the capability of precipitating at least one intermetallic compound precipitate selected from the group consisting of a Laves phase of $Fe_2W$, a Laves phase of $Fe_2Mo$, a $\mu$ phase, and a compound represented by $Ni_3X$, where X is Al or Ti, while using the steel at 650° C. or more.

2. The heat resistant high-chromium containing ferrite steel as claimed in claim 1, wherein the ferritic phase is contained at 70% by volume or more.

3. The heat resistant high-chromium containing ferrite steel as claimed in claim 1, wherein Mo is contained at 0.5–8.0% by weight and W is contained at 1.0–8.0% by weight.

4. The heat resistant high-chromium containing ferrite steel as claimed in claim 1, wherein the ferrite steel has a following chemical composition (weight %):

| | |
|---|---|
| Cr | 13~30 |
| Mo | 0.5~8.0 |
| W | 1.0~8.0 |
| Co | 1.0~10.0 |
| C | 0.50 or less |
| N | 0.20 or less |
| B | 0.01 or less |
| Nb | 0.01~2.0 |
| Fe | residue |

and may contain inevitable impurities.

* * * * *